US012310472B1

(12) United States Patent
Cretella et al.

(10) Patent No.: US 12,310,472 B1
(45) Date of Patent: May 27, 2025

(54) CASES FOR ELECTRONIC DEVICES

(71) Applicant: Apple Inc., Cupertino, CA (US)

(72) Inventors: Kristen L Cretella, San Francisco, CA (US); Camille I Henrot, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 210 days.

(21) Appl. No.: 18/353,685

(22) Filed: Jul. 17, 2023

Related U.S. Application Data

(60) Provisional application No. 63/400,624, filed on Aug. 24, 2022.

(51) Int. Cl.
*A45C 11/00* (2006.01)

(52) U.S. Cl.
CPC ..... *A45C 11/00* (2013.01); *A45C 11/001* (2025.01); *A45C 11/002* (2025.01); *A45C 11/003* (2025.01)

(58) Field of Classification Search
CPC ..... A45C 11/00; A45C 11/001; A45C 11/002; A45C 11/003; A45C 2011/001; A45F 5/00
USPC ..... 206/320
See application file for complete search history.

(56) References Cited

U.S. PATENT DOCUMENTS

| | | | | |
|---|---|---|---|---|
| 8,875,879 | B2 | 11/2014 | Diebel et al. | |
| 10,542,802 | B1 * | 1/2020 | Brown | A45C 11/00 |
| 10,715,894 | B1 | 7/2020 | Chamberlin et al. | |
| 11,342,720 | B2 | 5/2022 | Barth et al. | |
| 2014/0221056 | A1 * | 8/2014 | Gandhi | H04B 1/3888 455/575.8 |
| 2015/0341072 | A1 * | 11/2015 | Lai | H04B 1/3888 455/575.8 |
| 2016/0259377 | A1 | 9/2016 | Hoellwarth et al. | |
| 2017/0194999 | A1 | 7/2017 | Rothbaum | |
| 2017/0222683 | A1 * | 8/2017 | Adelmann | H04M 1/185 |
| 2017/0366217 | A1 * | 12/2017 | Bergreen | H04M 1/18 |
| 2021/0048894 | A1 | 2/2021 | Wang et al. | |
| 2022/0127761 | A1 | 4/2022 | Podhajny et al. | |

* cited by examiner

*Primary Examiner* — Jacob K Ackun
(74) *Attorney, Agent, or Firm* — Treyz Law Group, P.C.; Kendall P. Woodruff

(57) ABSTRACT

A case for an electronic device may include one or more buttons or logos. The case may have an inner wall that defines a recess for receiving the electronic device and an outer wall that forms an outer surface of the case. An opening may be formed in the outer wall to accommodate a button member or logo member. A layer of material such as a layer of fabric or polymer may have a first portion that forms at least part of the inner wall of the case and a second portion that extends into the opening in the outer wall. The second portion may wrap over the button member or logo member to form an outer surface of the button member or logo member, or the second portion may wrap under the button member or logo member to form a substrate for the button member or logo member.

20 Claims, 15 Drawing Sheets

CASES FOR ELECTRONIC DEVICES

This application claims the benefit of provisional patent application No. 63/400,624, filed Aug. 24, 2022, which is hereby incorporated by reference herein in its entirety.

FIELD

This relates generally to cases, and, more particularly, to cases for electronic devices.

BACKGROUND

Electronic devices such as cellular telephones, computers, and other electronic equipment are sometimes used in conjunction with external cases. A user may, for example, place an electronic device in a removable plastic case to protect the electronic device from scratches. Removable cases may also be used to personalize electronic devices.

It can be challenging to use input-output devices such as buttons on the electronic device when the electronic device is inside of a case. The case may include buttons for interacting with buttons on the electronic device, but these buttons may be unsightly or may require excessive force to provide button press input to the electronic device.

SUMMARY

A case for an electronic device may include one or more buttons. The case may have an inner wall that defines a recess for receiving the electronic device and an outer wall that forms an outer surface of the case. An opening may be formed in the outer wall to accommodate a button member. A layer of material such as a layer of fabric or polymer may have a first portion that forms at least part of the inner wall of the case and a second portion that extends into the opening. In some arrangements, the second portion of the layer of material may wrap over the button member to form an outer surface of the button. If desired, the layer of material may be a single continuous piece of fabric that forms both the inner and outer walls of the case and that also covers the button.

The button may be surrounded by a button trim ring and/or debossed portions of the outer wall of the case. In some arrangements, first and second button members may be located in the opening of the outer wall of the case. The layer of material covering the first and second button members may have a debossed portion between the first and second button members to allow the first and second button members to move independently of one another. To provide the button with sufficient compliance, the layer of material may have locally thinned regions, slits or perforations, and/or extra material located in the vicinity of the button.

In some arrangements, the second portion of the layer of material may wrap under the button member to form a substrate for the button member. The button member may be a rigid metal or plastic member that is covered with a layer of fabric. Stitches may be used to attach the button member to the second portion of the layer of material. In some arrangements, the button member may be an embroidered button member formed from stitches that pass through the second portion of the layer of material.

A case may include one or more logos. The case may include an inner fabric layer that defines a recess for receiving the electronic device and an outer fabric layer with an opening for receiving the logo member. The logo member may be covered with a layer of material such as an additional layer of fabric. The additional layer of fabric may be trimmed at the base of the logo or may extend between the inner and outer fabric layers of the case.

DETAILED DESCRIPTION

An electronic device may be provided with a case such as a case formed from fabric, polymer, leather, and/or other materials. The case may be a removable external case. When a user desires to protect an electronic device from scratches or other damage, the user may place the electronic device within the case. When the user wishes to use a different case to change the appearance of the electronic device, the electronic device may be transferred from one case to another.

A case may include one or more buttons to allow a user to actuate buttons on the electronic device inside of the case. The button on the case may include a button member that is covered by a layer of material such as a layer of fabric or polymer that extends through an opening in the case. The layer of material may form part of an inner wall of the case, may be cut to form a seam that is hidden on the interior of the case, may form part of both inner and outer walls of the case, and/or may have other configurations. Covering the button member with a layer of material that extends through an opening in the case provides the button member with an aesthetically pleasing appearance without requiring excessive force to actuate the button on the electronic device. In some arrangements, the layer of material that extends into the opening may form a substrate for the button member. A logo member may also be covered with a layer of material that passes through an opening in the case. In some arrangements, a button member or logo member may be formed from stitches of material (e.g., embroidery).

Figure 1:
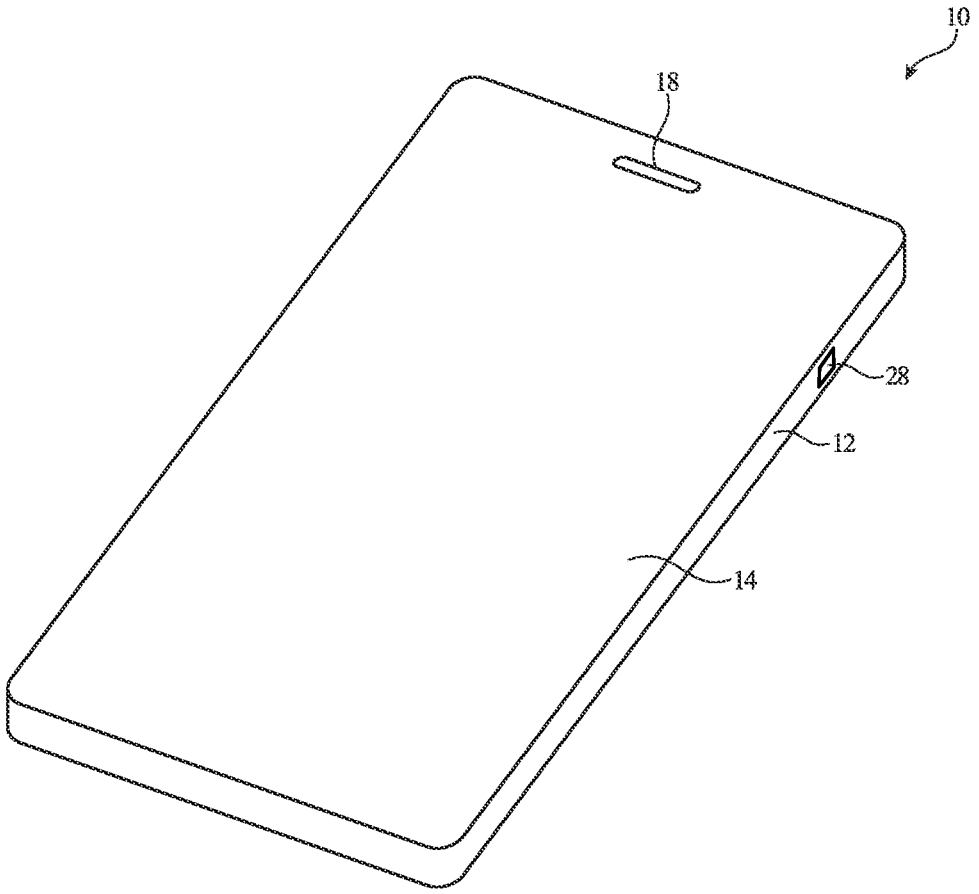
FIG. 1 is a perspective view of an illustrative electronic device in accordance with an embodiment.

An electronic device of the type that may be provided with a case having one or more buttons and/or logos is shown in FIG. 1. In the example of FIG. 1, device 10 includes a display such as display 14 mounted in housing 12. Housing 12, which may sometimes be referred to as an enclosure or case, may be formed of plastic, glass, ceramics, fiber composites, metal (e.g., stainless steel, aluminum, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.).

Display 14 may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Display 14 may include an array of pixels formed from liquid crystal display (LCD) components, an array of electrophoretic pixels, an array of plasma pixels, an array of organic light-emitting diode pixels or other light-emitting diodes, an array of electrowetting pixels, or pixels based on other display technologies.

Display 14 may be protected using a display cover layer such as a layer of transparent glass or clear plastic. The display cover layer may form a planar front face for device 10. The rear of housing 12 may have a parallel planar surface. Housing sidewalls may run around the periphery of housing 12. Device 10 may have a rectangular outline (e.g., a rectangular footprint when viewing the front face of the device) or may have other suitable footprints.

Openings may be formed in the display cover layer. For example, an opening may be formed in the display cover layer to accommodate ports such as speaker port 18. Openings may also be formed in housing 12 to form communications ports (e.g., an audio jack port, a digital data port, etc.), to form openings for buttons such as button 28, etc. Buttons such as button 28 may be located on a sidewall portion of device 10, if desired. Buttons such as button 28 may include power buttons, volume buttons, sleep and wake buttons, silent mode slider switches, and/or any other suitable buttons.

Electronic device 10 may be a computing device such as a laptop computer, a computer monitor containing an embedded computer, a tablet computer, a cellular telephone, a media player, or other handheld or portable electronic device, a smaller device such as a wrist-watch device, a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment. In the illustrative configuration of FIG. 1, device 10 is a portable device such as a cellular telephone, media player, tablet computer, or other portable computing device. Other configurations may be used for device 10 if desired. The example of FIG. 1 is merely illustrative.

Figure 2:
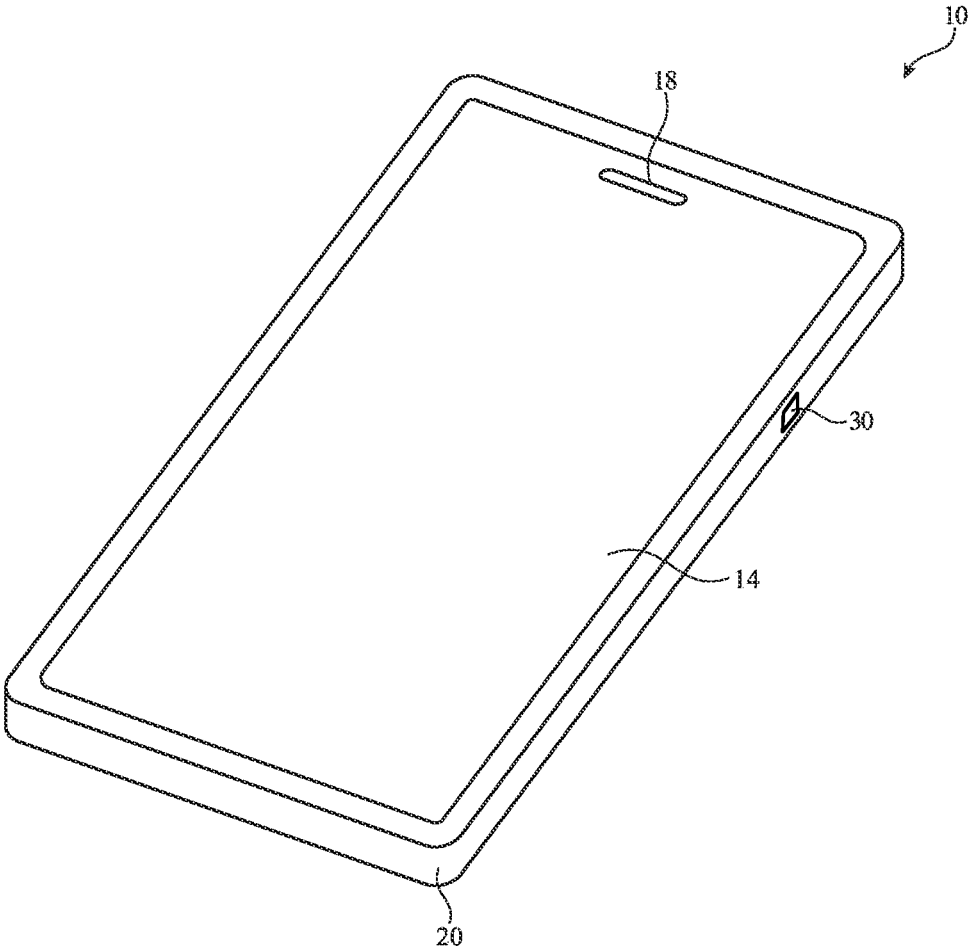
FIG. 2 is a perspective view of an illustrative electronic device inside of a case in accordance with an embodiment.

FIG. 2 is a perspective view of device 10 of FIG. 1 in a configuration in which device 10 has been mounted in a case. Case 20 may be removable or may be permanently attached to device 10. As shown in FIG. 2, case 20 may have walls that extend around the periphery of device 10. If desired, case 20 may form a cover with a hinged portion, a structure with a pocket into which device 10 may slide, or other enclosure that receives device 10. In the example of FIG. 2, case 20 surrounds device 10, but does not cover display 14. This type of arrangement, which may be desirable for devices such as cellular telephones, watches, and tablet computers, allows display 14 to be viewed by a user without opening a cover flap or moving any portion of case 20. If desired, however, case 20 may be provided with pockets, flaps, hinged portions, straps, and other structures. The configuration of FIG. 2 is merely illustrative.

Case 20 may include one or more openings, buttons, and/or logos. A logo may be placed on a rear face of case 20. Openings and buttons such button 30 may be aligned with corresponding input-output components in device 10 when device 10 is received within case 20. For example, button 30 may align with button 28 of device 10. A user may actuate button 28 on device 10 by pressing button 30 on case 20. Buttons such as button 30 and logos on case 20 may each be covered by or formed on a layer of material that extends through an opening in the case. The layer of material that covers the button or logo (or that forms a substrate for the button or logo) may form part of an inner wall of the case, an outer wall of the case, and/or may have cut edges that form a seam on the interior of the device. This type of arrangement may provide a seamless appearance and a more compliant button 30 so that users can actuate button 28 on device 10 without requiring excessive force. In some arrangements, buttons and/or logos on case 20 may be formed from stitches of material to form an embroidered button or an embroidered logo.

Figure 3:
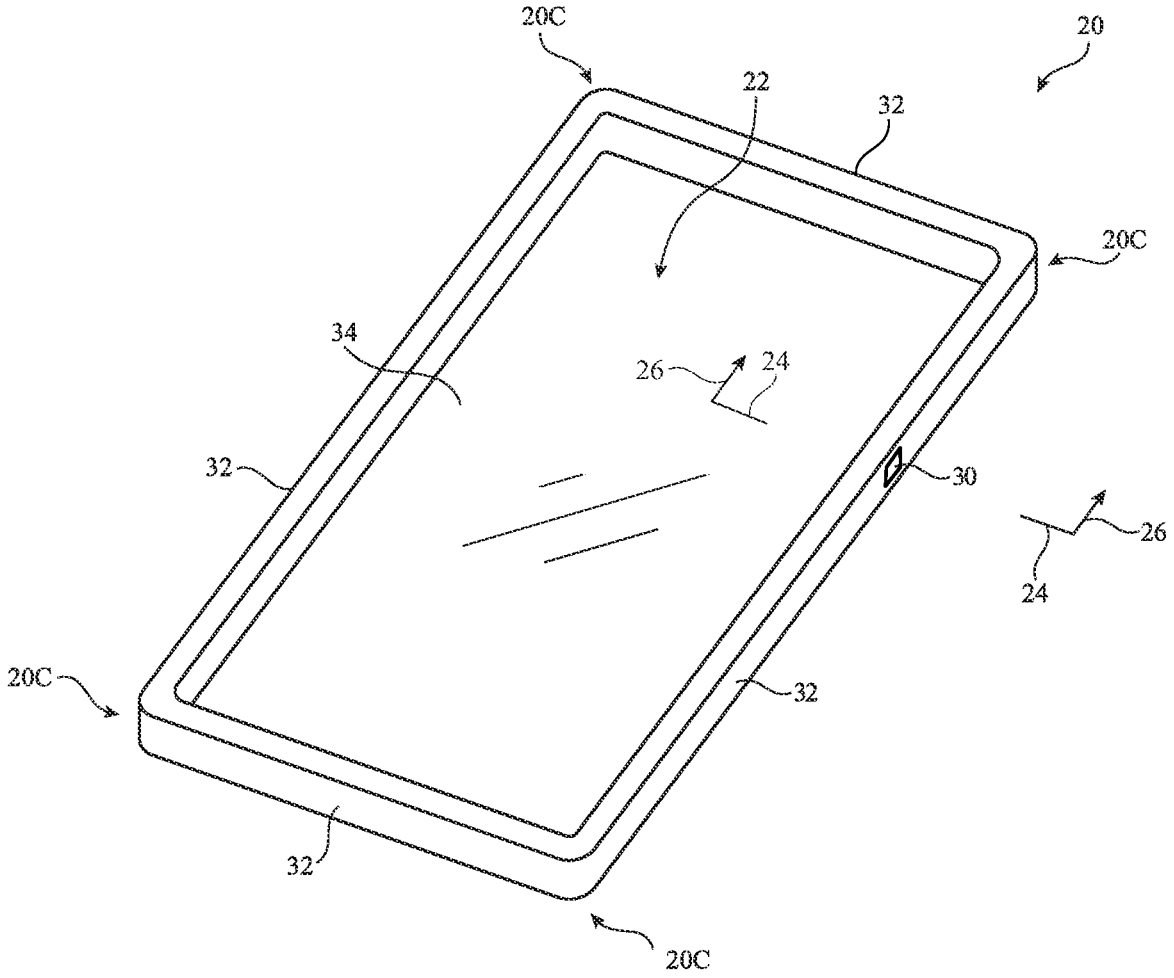
FIG. 3 is a perspective view of an illustrative case in accordance with an embodiment.

FIG. 3 is a perspective view of case 20 of FIG. 2 in a configuration in which device 10 is not present (i.e., a configuration in which case 20 has been removed from device 10). As shown in FIG. 3, case 20 may have a rear wall such as rear wall 34 and four sidewalls such as sidewalls 32. Sidewalls 32 may each extend along and cover a respective one of the four sidewalls of device 10. Corner portions 20C of case 20 join sidewalls 32 together to form a case with a rectangular ring shape. Corners 20C may be rounded when viewed from above (i.e., when case 20 has a footprint with rounded corners) or may have other shapes. Central recess 22 may have a rectangular shape (e.g., a rectangular shape with rounded corners) or other shape suitable for receiving electronic device 10 when electronic device 10 is mounted within case 20.

Case 20 may have one or more portions formed from fabric, polymer, wood, leather, ceramic, fiber composites, and/or any other suitable materials. Fabric portions of case 20 may be soft (e.g., case 20 may have a fabric surface that yields to a light touch), may have a rigid feel (e.g., the surface of case 20 may be formed from a stiff fabric), may be coarse, may be smooth, may have ribs or other patterned textures, and/or may be formed as part of a device that has portions formed from non-fabric structures of plastic, metal, glass, crystalline materials, ceramics, or other materials.

In arrangements where case 20 includes fabric, the fabric may be formed from strands of material that are woven, knit, braided, or otherwise interlaced (e.g., using intertwining equipment such as weaving equipment, knitting equipment, or braiding equipment). The strands of material may be single-filament strands (sometimes referred to as fibers or monofilaments), may be yarns or other strands that have been formed by intertwining multiple filaments (multiple monofilaments) of material together, or may be other types of strands (e.g., tubing). Monofilaments for fabric may include polymer monofilaments and/or other insulating monofilaments and/or may include bare wires and/or insulated wires. Monofilaments formed from polymer cores with metal coatings and monofilaments formed from three or more layers (cores, intermediate layers, and one or more outer layers each of which may be insulating and/or conductive) may also be used. Elastic materials such as elastomeric silicone or other elastomers may be used to form stretchable strands of material that can be interlaced to form a stretchable fabric.

Fabric may include strands of material formed from polymer, metal, glass, graphite, ceramic, natural materials as cotton or bamboo, or other organic and/or inorganic materials and combinations of these materials. Conductive coatings such as metal coatings may be formed on non-conductive material. For example, polymer strands of material may be coated with metal to make the strands conductive. Reflective coatings such as metal coatings may be applied to make strands and monofilaments reflective. Strands may be formed from a bundle of bare metal wires or metal wire intertwined with insulating monofilaments (as examples).

As shown in FIG. 3, case 20 may have peripheral portions such as peripheral wall portions 32 and a rear wall portion such as back panel 34. Back panel 34 (sometimes referred to as a rear wall) may cover the rear side of electronic device 10 when device 10 is within case 20. Peripheral walls 32 (sometimes referred to as sidewalls) may include vertical sidewalls that extend around the periphery of device 10 when device 10 is installed within case 20. The planar shape of sidewalls 32 of FIG. 3 is merely illustrative. If, for example, device 10 has edges with a curved cross-sectional shape, the profile of peripheral walls 32 may have a corresponding curved shape (e.g., sidewall 32 may bow outwards). If desired, case 20 may be formed from compliant materials to accommodate and/or conform to devices 10 with a variety of different edge profiles and footprints. The example of FIG. 3 is merely illustrative.

Back panel 34 may be formed from polymer, fabric, metal, and/or other suitable materials. Back panel 34 may cover some or all of the rear of device 10 and may be attached to sidewalls 32 or woven or formed as an integral portion of sidewalls 32.

Figure 4:
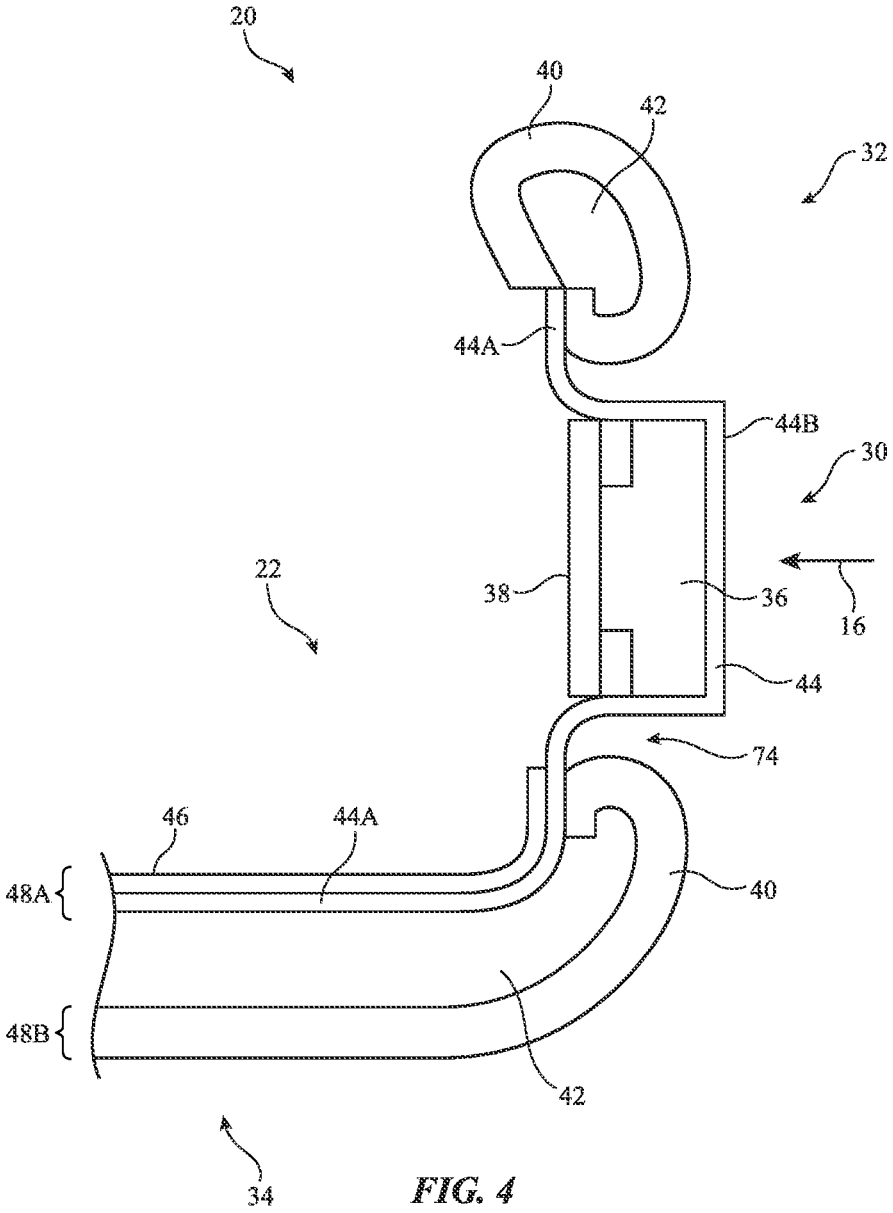
FIG. 4 is a cross-sectional side view of an illustrative case with a button member that is covered by a layer of material that passes through an opening in the case and that forms at least part of an inner wall of the case in accordance with an embodiment.

A cross-section of case 20 in the vicinity of button 30 (taken along line 24 and viewed in direction 26) is shown in FIG. 4. As shown in FIG. 4, case 20 may include inner and outer walls such as inner wall 48A and outer wall 48B. Inner wall 48A may form the interior lining of case 20 that defines recess 22 for receiving device 10. Outer wall 48B may form an exterior surface of case 20 and may contact a user's hands when case 20 is being held. Inner wall 48A and outer wall 48B may be separated by a filler material such as filler material 42. Filler material 42 may be formed from foam, plastic, fiberglass, metal, fabric, or other suitable materials.

Inner fabric wall 48A may be formed from one or more layers of material such as inner layer 46 and layer 44. Outer wall 48B may be formed from a layer of material such as outer layer 40. Layers 46, 44, and 40 may be formed from fabric (e.g., tubular knit fabric, flat knit fabric, warp knit fabric, woven fabric, braided fabric, etc.), polymer (e.g., polyethylene terephthalate, polyurethane, thermoplastic polyurethane, elastomer, etc.), non-woven materials, metal, and/or any other suitable material. With one illustrative configuration, outer layer 40 is a layer of tubular knit fabric and layers 44 and 46 are polymer layers. In other configurations, outer layer 40 may be formed from a first tubular knit layer (e.g., an outer tubular knit layer), and layer 44 may be formed from a second tubular knit layer (e.g., an inner tubular knit layer).

As shown in FIG. 4, case 20 may include one or more buttons such as button 30. Button 30 may be located on sidewall 32 and may be configured to align with button 28 on device 10. Button 30 may be located in an opening in case 20 such as opening 74. Opening 74 may pass through outer wall 48B (e.g., opening 74 may be surrounded by edges of outer layer 40 of outer wall 48B) and may, in some arrangements, pass through inner wall 48A. When button 30 is pressed in direction 16, button 30 may move within opening 74 towards button 28 of device 10. When fully depressed, button 30 may press button 28 to actuate button 28. Button press input to button 28 may, for example, be used to turn device 10 on or off, to silence an incoming telephone call, to switch device 10 between a sleep and wake mode, to adjust the volume of audio output from device 10, and/or to take other suitable actions.

Button 30 may include a button member such as button member 36 mounted to substrate 38 (e.g., a polycarbonate substrate or a substrate formed from any other suitable material). Button member 36 may be a rigid member formed from metal, plastic, or other suitable materials. In some arrangements, button member 36 may be formed from fabric. For example, strands of material may be stitched on to a substrate such as substrate 38 to form an embroidered button. In the example of FIG. 4, button member 36 is formed from rigid member of metal or plastic.

Button member 36 may be covered with a layer of material such as layer 44. Layer 44 may pass through opening 74 and may have exterior portions on the exterior of case 20 and interior portions on the interior of case 20. In the example of FIG. 4, layer 44 has a first portion such as inner portion 44A that forms at least part of inner wall 48A and a second portion such as outer portion 44B that forms an outer surface of button 30. Inner portion 44A of layer 44 may form an interior lining of case 20 that extends partially or completely across inner wall 48A. Outer portion 44B may be formed into a button shape and may poke through opening 74 to cover button member 36. If it is desired to have a contrasting appearance between the outer surface of button 30 and the inner surface of case 20, inner layer 46 may be placed over (e.g., adhered or otherwise bonded) to inner portion 44A of layer 44. This is merely illustrative. If desired, layer 46 may be omitted.

Portion 44B of layer 44 that forms an outer surface of button 30 may have the same appearance as surrounding outer material 40, or the two layers may have contrasting appearance. For example, portion 44B of layer 44 may be formed from a first type of fabric (e.g., twill, plain weave, etc.), while surrounding outer layer 40 may be formed from a second type of fabric with a contrasting appearance and/or feel (e.g., twill, plain weave, etc.). As another example, portion 44B of layer 44 may be formed from polymer, while surrounding outer layer 40 may be formed from fabric. Arrangements in which portion 44B and outer layer 40 have different colors may also be used. In general, portion 44B and outer layer 40 may have any suitable combination of materials, fabric constructions, colors, textures, patterns, etc.

Because button 30 is covered by layer 44 that extends through opening 74 (e.g., from outside of case 20 to the interior of case 20), button 30 may appear to be seamlessly integrated into case 20. Additionally, the extra material of layer 44 that extends below button 30 (e.g., extending towards inner wall 48A of case 20) allows layer 44 to hold button member 36 in place without requiring excessive force to press button 30 (e.g., because the additional material of layer 44 inside of case 20 provides additional slack to allow button 30 to be depressed easily). Even when layer 44 is formed from a woven fabric (e.g., to form a woven button 30) that has little to no stretch, layer 44 may still remain sufficiently compliant to allow button member 36 to travel within opening 74.

Figure 5:
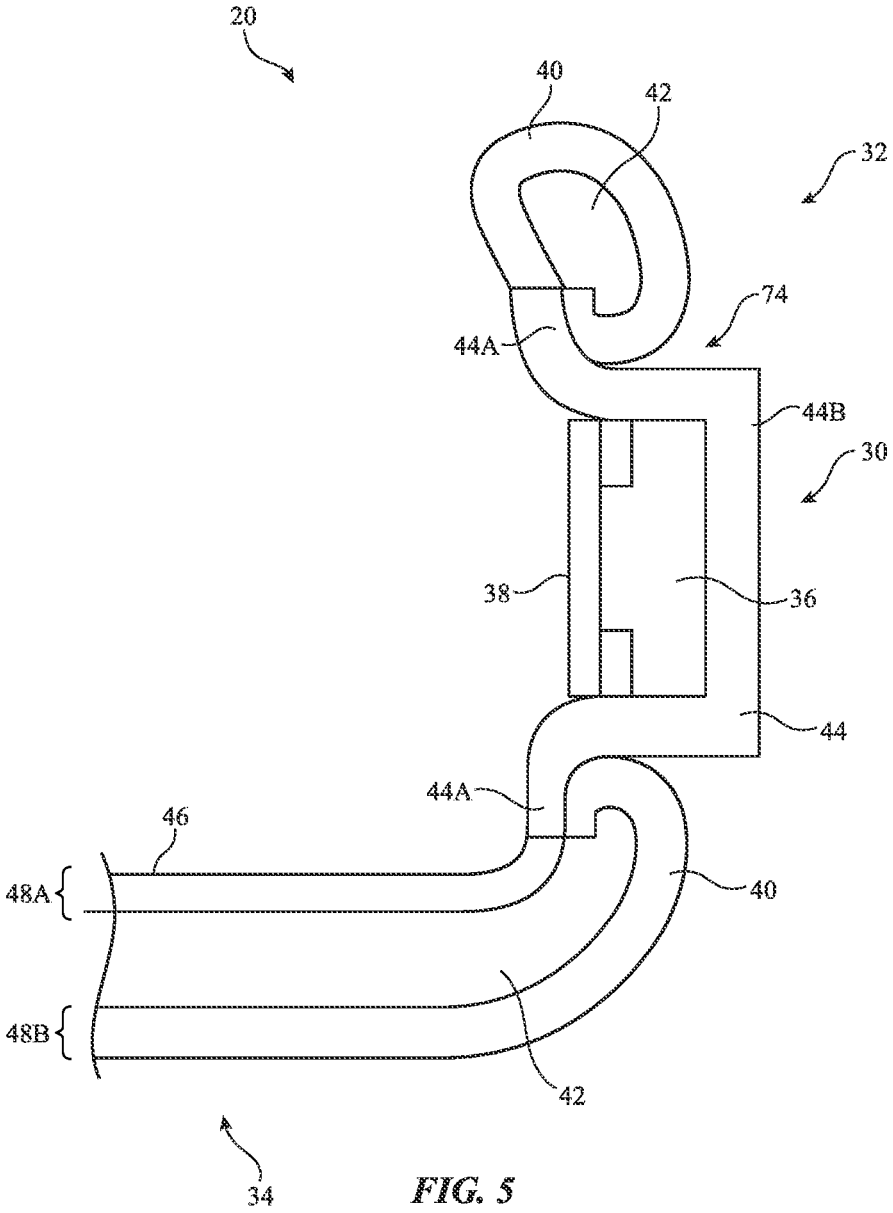
FIG. 5 is a cross-sectional side view of an illustrative case with a button member that is covered by a layer of material that passes through an opening in the case and that has trimmed edges located at an inner wall of the case in accordance with an embodiment.

In the example of FIG. 5, layer 44 has been trimmed closer to button 30 while still providing sufficient material to allow low-force pressing of button 30. Layer 44 includes inner portion 44A that forms at least part of inner wall 48A of case 20 and outer portion 44B that forms an outer surface of button 30. In this arrangement, most of inner wall 48A is formed by inner layer 46. Inner layer 46 may have edges that join with the edges of layer 44 near button 30. The edges of layer 44 may be located at inner wall 48A so that the seam between inner portion 44A and inner layer 46 is hidden inside of case 20 and not viewable from the outside through opening 74.

Figure 6:
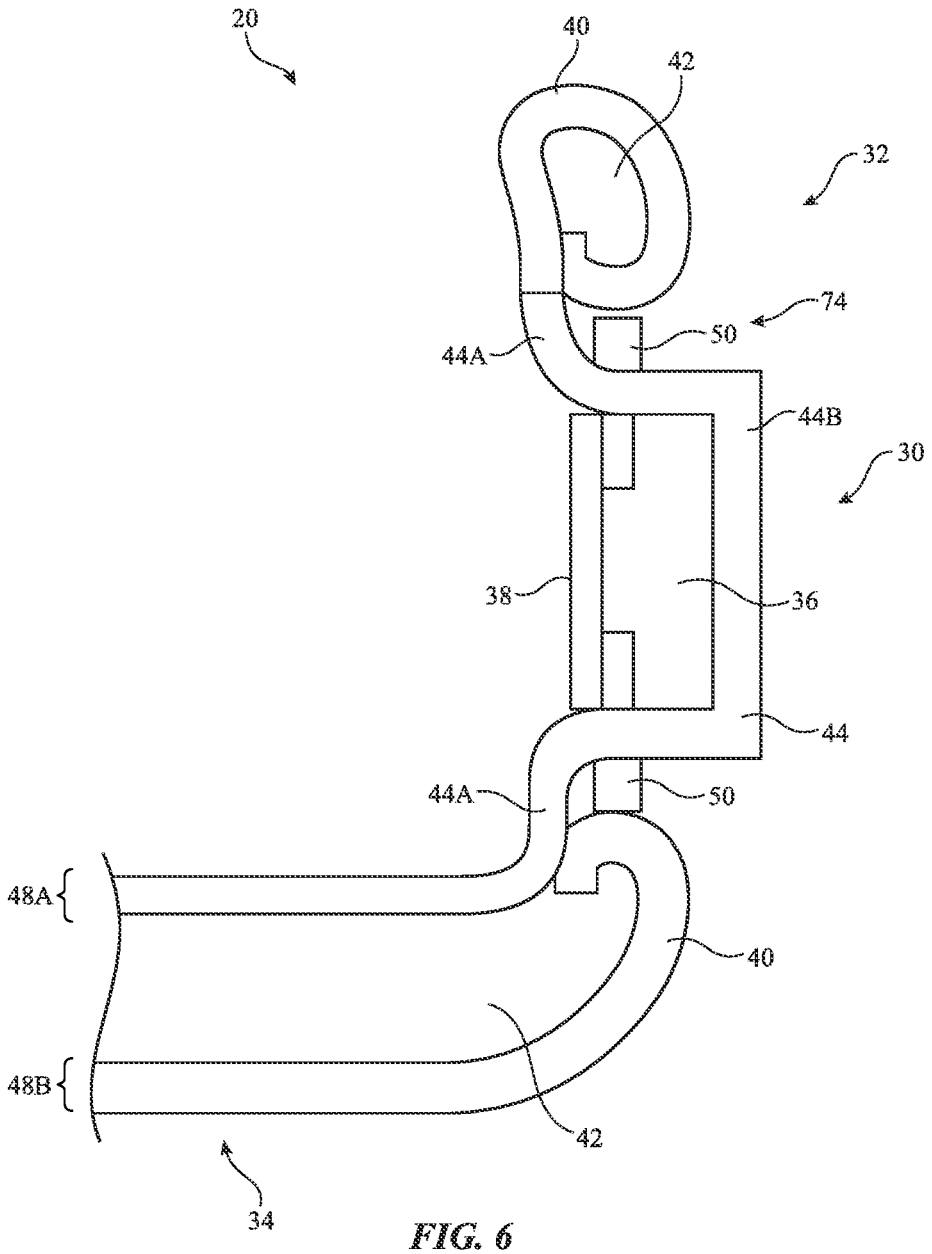
FIG. 6 is a cross-sectional side view of an illustrative case with a button member surrounded by a button trim ring in accordance with an embodiment.

If desired, a button trim ring may be placed around the periphery of button 30. This type of arrangement is illustrated in FIG. 6. As shown in FIG. 6, a trim member such as button trim ring 50 may be mounted to case 20 and may extend around the periphery of button 30. Button trim ring 50 may be formed from elastomer, may be formed from rigid material such as plastic or metal, or may be formed from a coating (e.g., an ink coating or printed layer) to form a visual border around button 30 that has a contrasting appearance with material 44 and/or material 40.

Figure 7:
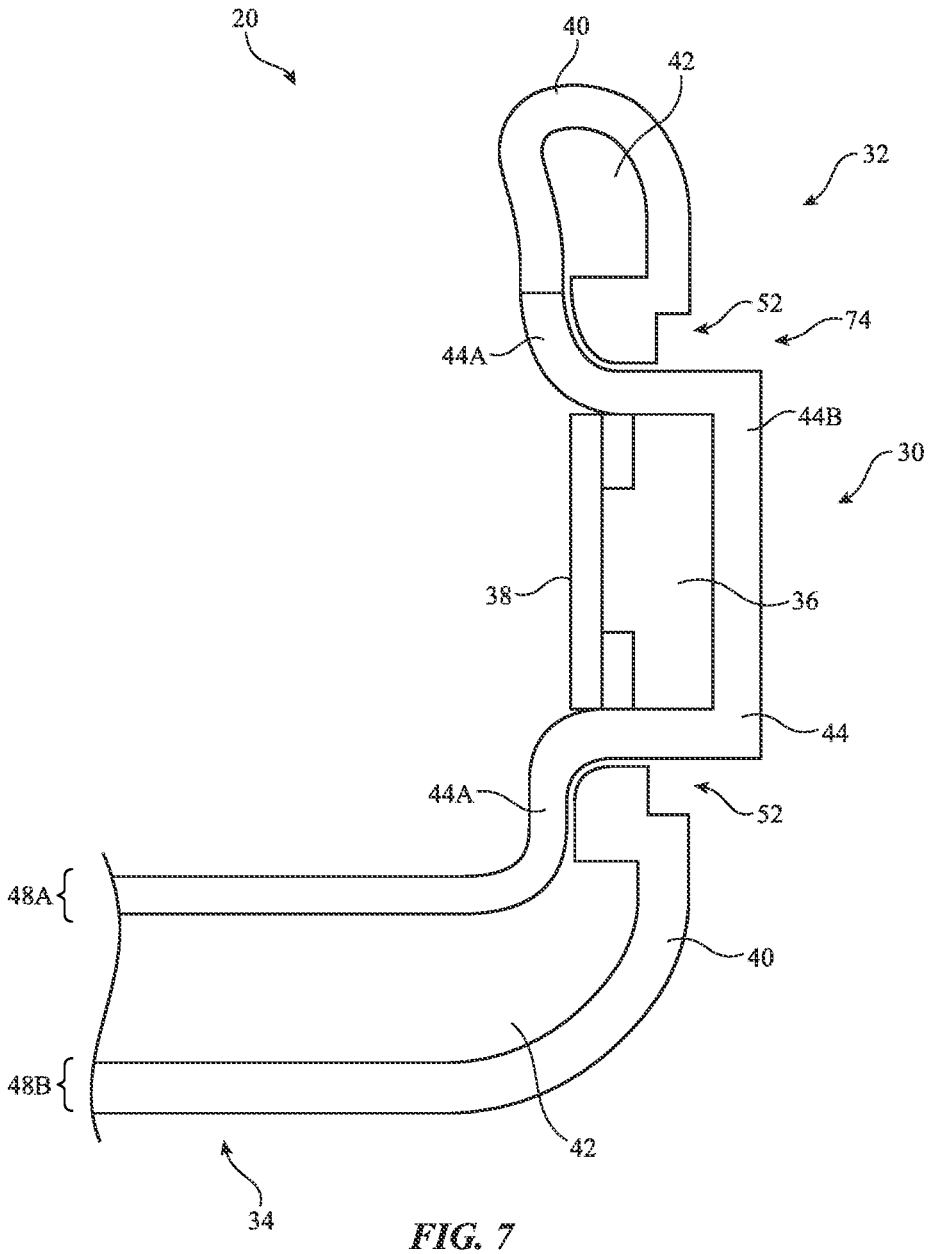
FIG. 7 is a cross-sectional side view of an illustrative case with a button member surrounded by a debossed layer in accordance with an embodiment.

FIG. 7 shows an illustrative example in which the fabric surrounding button 30 is debossed. As shown in FIG. 7, outer layer 40 may include debossed portions such as debossed portions 52 around the periphery of button 30. Portions 52 may be debossed using a heat treatment that causes the edges of layer 40 surrounding opening 74 to be recessed relative to the rest of layer 40. If desired, button 30 may be surrounded by debossed portions 52 of layer 40 and a trim member such as trim member 50 of FIG. 6. The example of FIG. 7 is merely illustrative.

Figure 8:
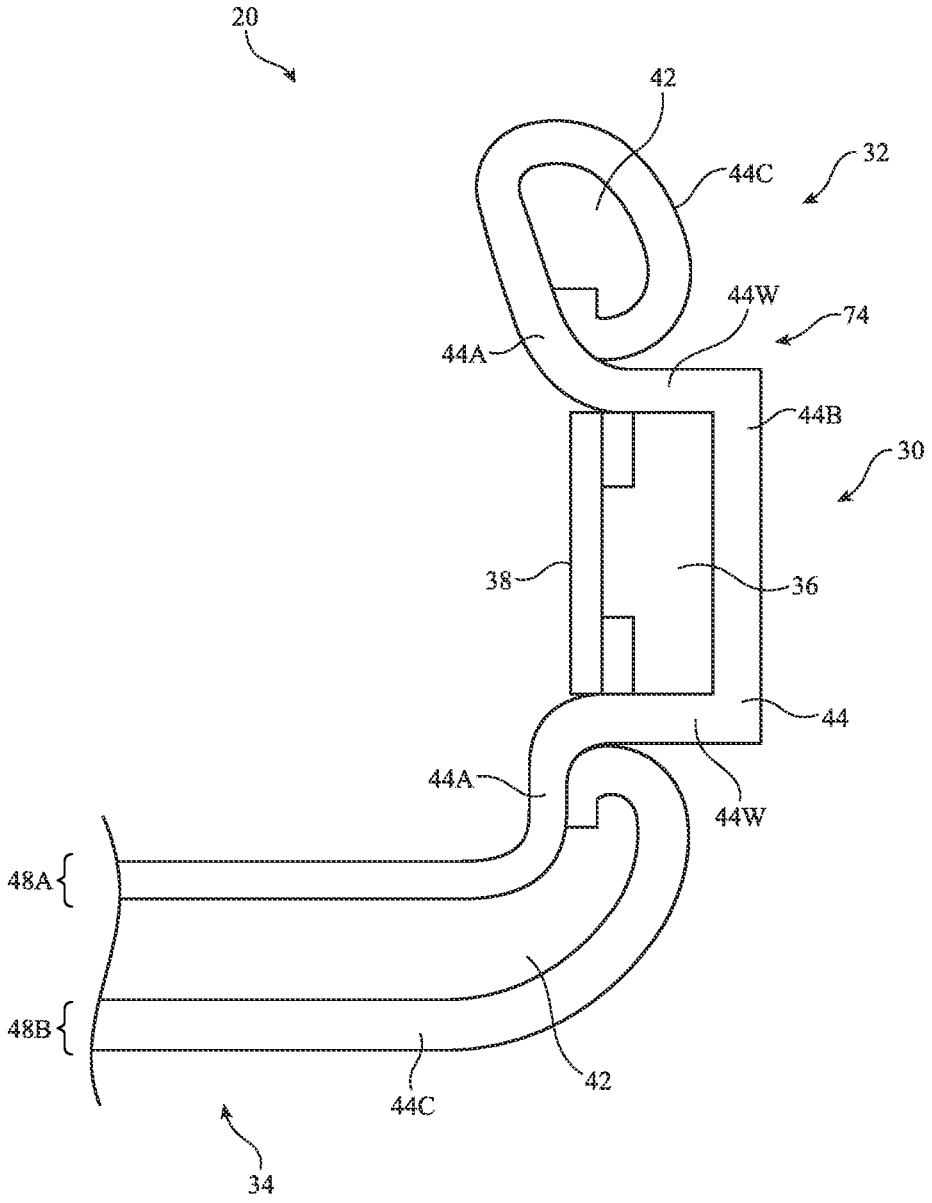
FIG. 8 is a cross-sectional side view of an illustrative case with a button member that is covered by a layer of material that forms at least part of inner and outer walls of the case in accordance with an embodiment.

FIG. 8 shows an example in which the inner and outer walls of case 20 are formed from a continuous piece of material. As shown in FIG. 8, layer 44 has a first portion such as inner portion 44A that forms at least part of inner wall 48A of case 20, a second portion such as button portion 44B that forms an outer surface of button 30, and a third portion such as outer portion 44C that forms at least part of outer wall 48B of case 20. Layer 44 may be formed from a single piece of fabric, if desired. Layer 44 may have the same appearance and texture throughout portions 44A, 44B, and 44C, or the different regions may have different appearances (e.g., different colors), different fabric constructions, different textures, etc. In one illustrative arrangement, inner portion 44A and button portion 44B have a matching color and fabric construction (e.g., flat knit, bird's eye, jersey, knit-tuck, etc.), whereas outer portion 44C may have a different color, fabric construction (e.g., twill, plain weave, etc.), texture, etc.

In some arrangements, layer 44 may be a Jacquard fabric that is formed on a Jacquard loom. A Jacquard loom allows complex patterns to be woven into the fabric. For example, a Jacquard loom may be used to form fabric 44 with discrete zones of different fabric constructions. A zone of fabric 44 over button 30 such as portion 44B (sometimes referred to as a Jacquard zone) may have a different fabric construction than the rest of layer 44. If desired, a gradual transition between the fabric construction of inner portion 44A of layer 44 and button portion 44B of layer 44 may be located along the sidewalls of button 30. For example, layer 44 may have sidewall portions 44W that form the sides of button 30. A pixelated transition between the first fabric construction of button portion 44B (the Jacquard zone) and the second fabric construction of inner portion 44A may be located along sidewall portions 44W of layer 44 so that the transition is not easily viewable from the outside of case 20.

Figure 9:
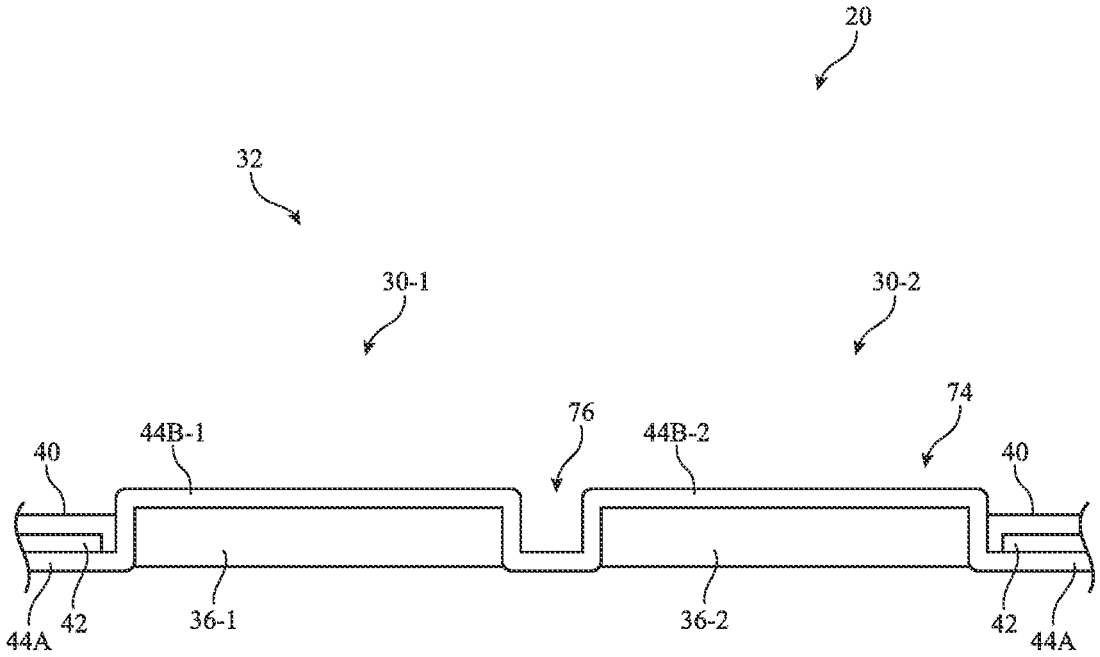
FIG. 9 is a cross-sectional side view of an illustrative case with first and second button members that are covered by a layer of material that passes through an opening in the case and that has a recess between the first and second button members in accordance with an embodiment.

If desired, layer 44 may be used to cover more than one button within opening 74. This type of arrangement is illustrated in FIG. 9. As shown in FIG. 9, case 20 may include first and second buttons such as button 30-1 and button 30-2. Buttons 30-1 and 30-2 may be aligned with respective first and second buttons on electronic device 10 (e.g., a volume up button and a volume down button, or other suitable buttons). Buttons 30-1 and 30-2 may include respective button members 36-1 and 36-2 located in opening 74. Layer 44 may have inner portion 44A that forms at least part of an interior surface of case 20 (e.g., inner wall 48A of FIG. 4) and outer portions 44B-1 and 44B-2 that extend through opening 74 to cover button members 36-1 and 36-2. To allow button members 36-1 and 36-2 to move independently of one another within opening 74, layer 44 may include recessed portion 76 between button members 36-1 and 36-2. Recessed portion 76 may be debossed using a heat treatment that causes portion 76 to be recessed relative to button portions 44B-1 and 44B-2. Debossed portion 76 may be relatively deep to form a recess that extends all the way down the sides of button members 36-1 and 36-2 (as shown in the example of FIG. 9), or debossed portion 76 may be relatively shallow to form a recess that extends only partially down the sides of button members 36-1 and 36-2.

FIGS. 10, 11, 12, and 13 show illustrative ways of increasing compliance of layer 44 around the vicinity of button 30 to ensure that low amounts of force are needed to press button 30 and actuate button 28 on device 10. These techniques may allow layer 44 to be formed using a stiff and/or non-stretchable material while still providing sufficient compliance to allow low-force actuation of button 28 on device 10.

Figure 10:
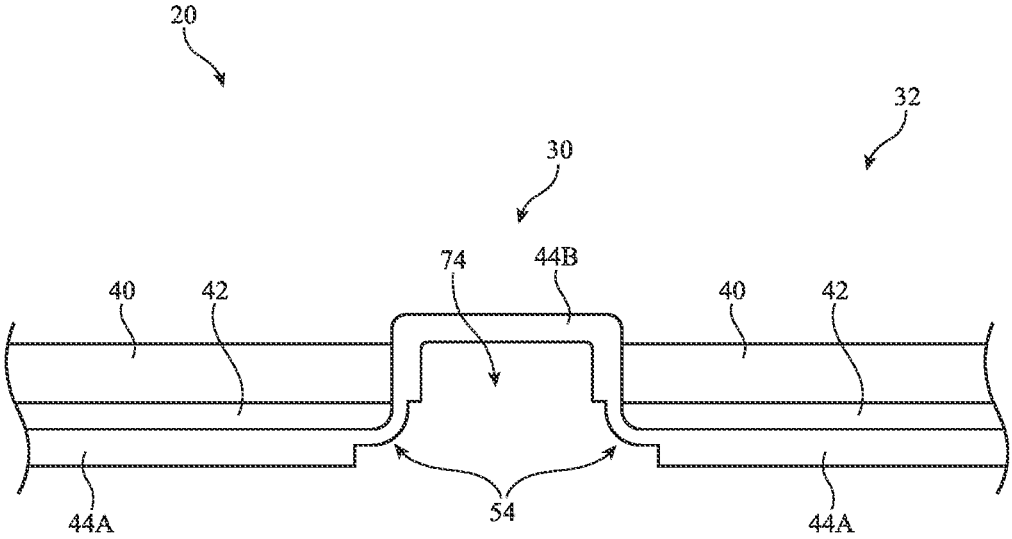
FIG. 10 is a cross-sectional side view of an illustrative case with a button member that is covered by a layer of material with locally thinned regions to increase compliance of the layer of material in accordance with an embodiment.

In the example of FIG. 10, layer 44 has locally thinned regions 54. Locally thinned regions 54 may be formed by removing material from layer 44 via laser ablation or using other techniques. Locally thinned regions 54 may have a reduced thickness relative to other portions of layer 44. Locally thinned regions 54 may surround a periphery of button 30 and may be located at the base of button 30 (e.g., somewhere in the transition between inner portion 44A and button portion 44B of layer 44). This creates a folding point and reduces stress on layer 44, without requiring layer 44 to be formed from a stretchable material.

If desired, button portion 44B of layer 44 may be locally heated to thermoform portion 44B into the desired button shape while keeping the rest of layer 44 constrained. When button portion 44B is heated to the appropriate temperature (e.g., to achieve a flow state), a forming tool may be used to shape button portion 44B into the desired shape (e.g., a pill shape, a box shape, a hemispherical shape, or any other suitable shape).

Figure 11:
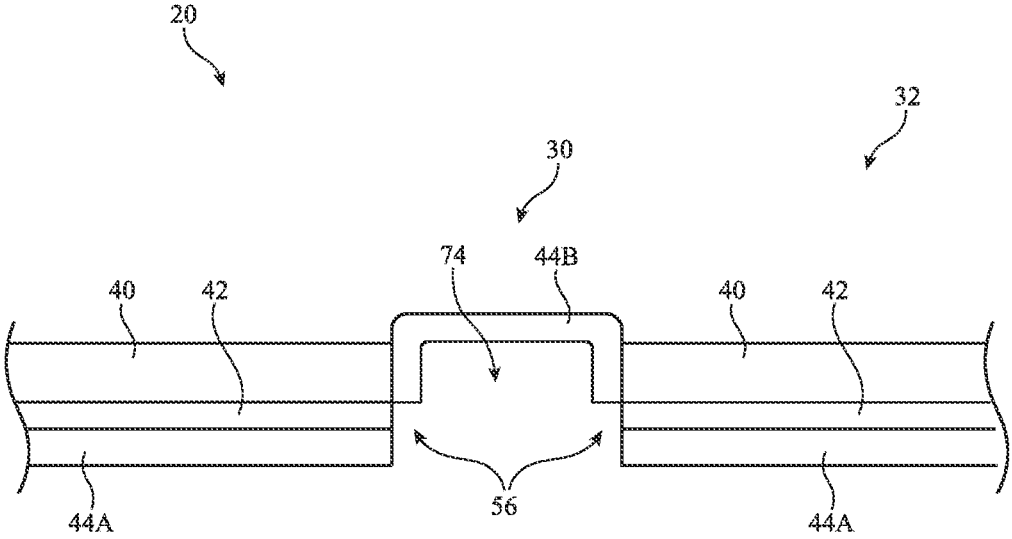
FIG. 11 is a cross-sectional side view of an illustrative case with a button member that is covered by a layer of material with openings to increase compliance of the layer of material in accordance with an embodiment.
Figure 12:
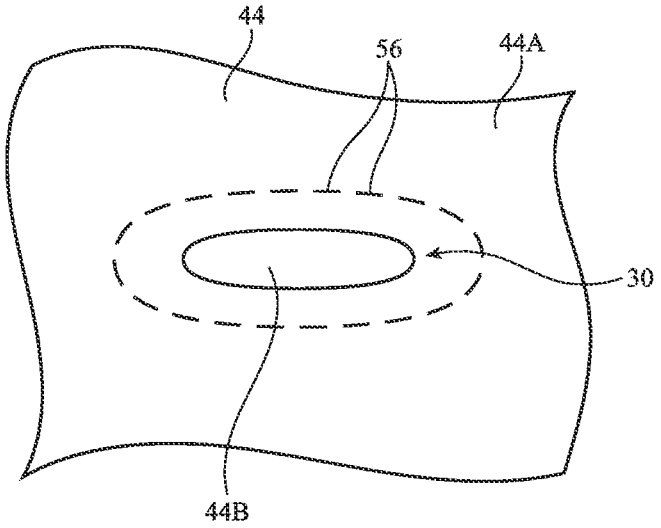
FIG. 12 is a top view of an illustrative case with a layer of material that covers a button member and has openings to increase compliance of the layer of material in accordance with an embodiment.

In the example of FIG. 11, openings are formed in layer 44 to increase compliance of layer 44. As shown in FIG. 11, layer 44 may include one or more openings 56. Openings 56 (e.g., slits, perforations, holes, etc.) may pass partially or completely through layer 44 and may surround some or all of the periphery of button 30. Openings 56 may, if desired, be diamond-shaped openings to allow for geometrical deformation that accommodates the shape of button 30. As shown in the top view of FIG. 12, openings 56 may form a pattern of stress relief slits around the periphery of button 30. Openings 56 may be formed at the base of button 30, along the sidewalls of button 30, or elsewhere between the top surface of button 30 (e.g., portion 44B) and inner portion 44A of layer 44.

Figure 13:
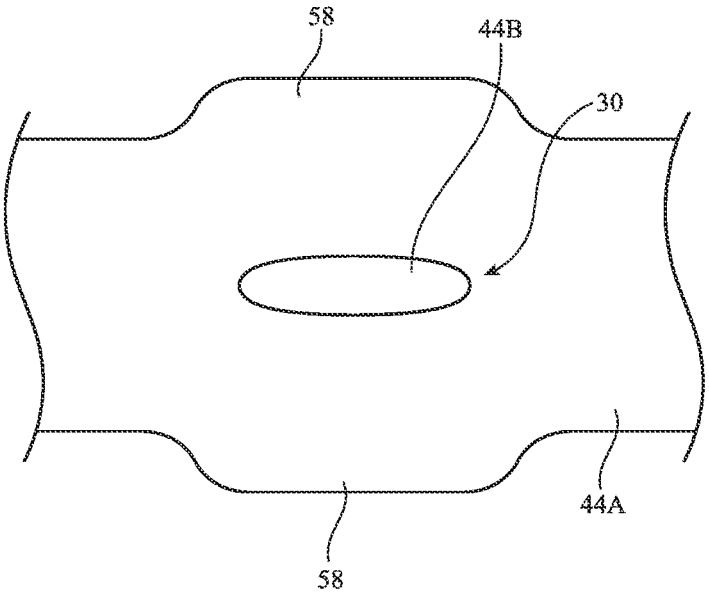
FIG. 13 is a top view of an illustrative case with a layer of material that covers a button member and that has been provided with additional slack to increase compliance of the layer of material in accordance with an embodiment.

FIG. 13 is a top view of layer 44 showing an example in which extra material 58 is provided in layer 44 to accommodate shaping of button portion 44B. Extra material may be added by increasing the size of layer 44 to accommodate button 30 or by changing the fabric construction of layer 44 within the vicinity of button 30. For example, a Jacquard loom can create a local construction change from a relatively dense fabric construction such as a plain weave in inner portion 44A and a less dense fabric construction such as a twill pattern in button portion 44B. In another illustrative arrangement, shuttle weaving may be used to locally increase weft material in button portion 44B relative to surrounding portion 44A of layer 44. This creates a buckling point in button portion 44B (so that button portion 44B easily forms into the shape of button 30) while also providing additional material to cover the volume of button 30.

Figure 14:
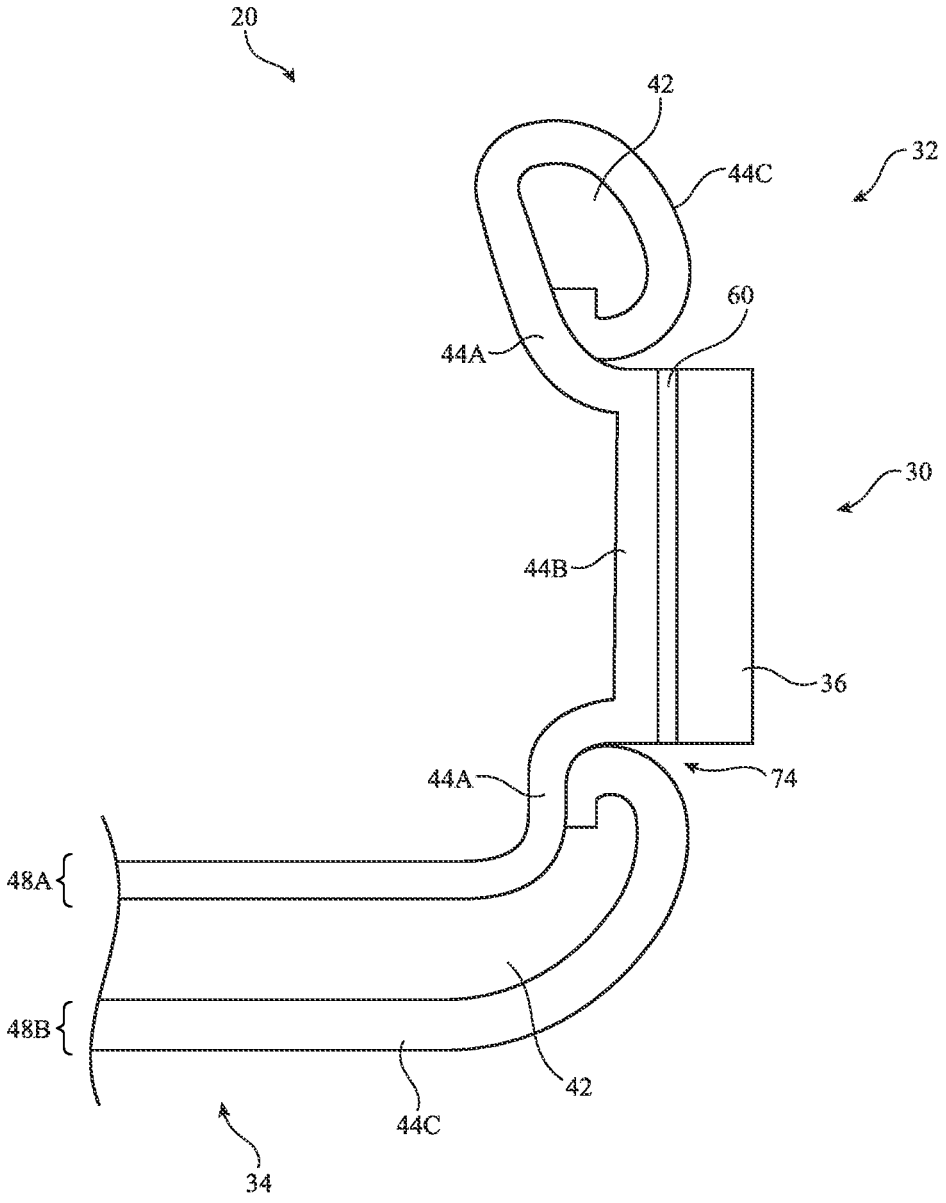
FIG. 14 is a cross-sectional side view of an illustrative case with a button member that is mounted to a layer of material that forms at least part of an inner wall of the case in accordance with an embodiment.

In the example of FIG. 14, layer 44 includes inner portion 44A that forms at least part of inner wall 48A of case 20, outer portion 44C that forms at least part of outer wall 48B of case 20, and button portion 44B that extends through opening 74 to form a button substrate for button 30. Instead of wrapping up and over the top of button 30, portion 44B is located inside of opening 74 and button member 36 is attached to button portion 44B using adhesive 60 and/or using any other suitable attachment mechanism. If desired, different layers may be used for inner wall 48A and outer wall 48B (e.g., as in the example of FIGS. 4, 5, 6 and 7).

Figure 15:
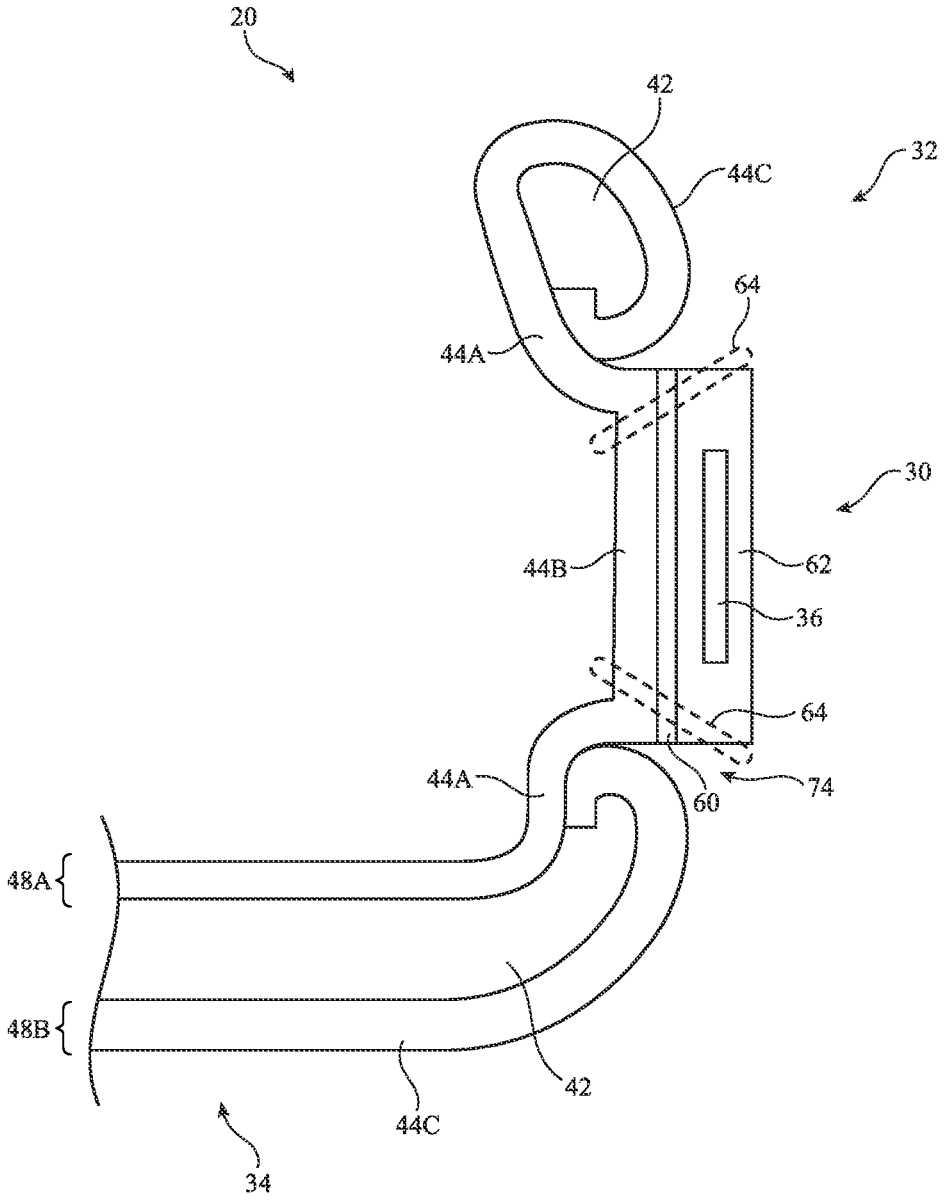
FIG. 15 is a cross-sectional side view of an illustrative case with a button member that covered by a layer of fabric in accordance with an embodiment.

FIG. 15 shows how an additional fabric layer such as fabric layer 62 (e.g., knit fabric, woven fabric, non-woven fabric, elastomeric material, etc.) may wrap partially or completely around button member 36 to form a fabric button. Fabric layer 62 may form a cap on button member 36 (e.g., without extending between button portion 44B and button member 36), or fabric layer 62 may wrap over and under button member 36 between button member 36 and button portion 44B (as shown in the example of FIG. 15).

Instead of or in addition to bonding button member 36 to button portion 44B of layer 44, stitches such as stitches 64 may be used to help secure button member 36 to button portion 44B. Stiches 64 (e.g., embroidery or other stitches) may pass through fabric layer 62 and layer 44. If desired, stitches 64 may be angled (as shown in the example of FIG. 9) so that the tops of stitches 64 are located on the sidewalls of button 30 (and not visible on the top surface of button 30). This is merely illustrative. Stiches 64 may extend parallel to the direction of travel of button member 36 to be visible on the top surface of button 30, if desired. Stitches 64 may, if desired, cover at least part of the sidewalls of button 30. Stitches 64 may be formed in any suitable pattern (e.g., straight, zig-zag, a single stitch, many stitches, etc.) in any suitable location (e.g., on the sidewalls of button 30, on the top surface of button 30, etc.).

Figure 16:
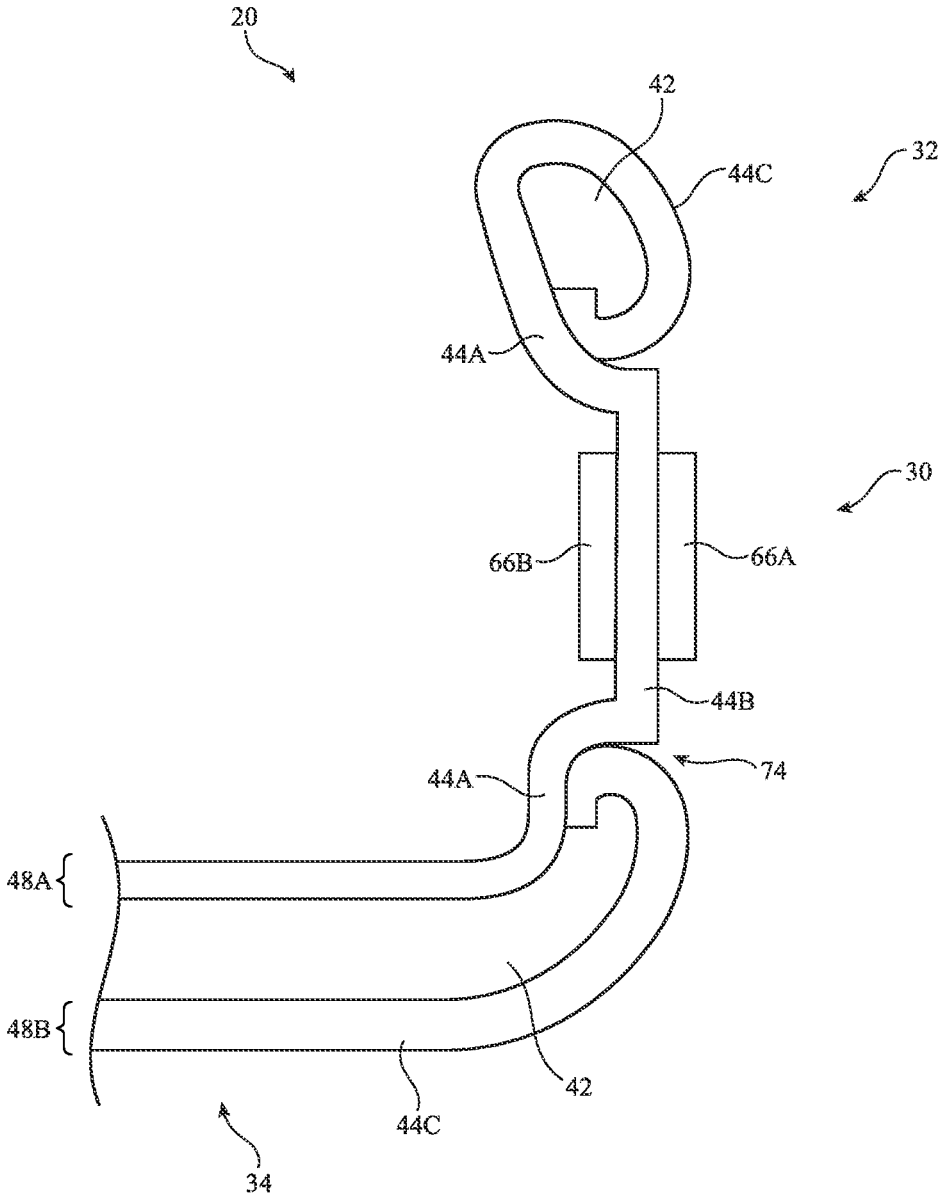
FIG. 16 is a cross-sectional side view of an illustrative case with an embroidered button member in accordance with an embodiment.

FIG. 16 shows another illustrative example in which button 30 is formed mostly or entirely from densely packed stitches such as embroidered stitches. As shown in FIG. 16, layer 44 includes inner portion 44A that forms at least part of inner wall 48A of case 20, outer portion 44C that forms at least part of outer wall 48B of case 20, and button portion 44B that extends through opening 74 to form a button substrate for button 30. Instead of wrapping up and over the top of button 30, portion 44B is located inside of opening 74 and forms a button substrate for button 30. If desired, different layers may be used for inner wall 48A and outer wall 48B (e.g., as in the example of FIGS. 4, 5, 6 and 7).

In the example of FIG. 16, button 30 is an embroidered button in which the button member is formed from stitches. As shown in FIG. 16, stitches 66A and 66B may pass through button portion 44B of layer 44 to form an embroidered button member on portion 44B of layer 44. Stitches 66A and 66B may include filler stitches that consume most of the volume of button 30 and outer stitches that that cover the filler stitches to create a button surface for button 30. If desired, the filler stitches may be replaced with a filler material such as foam, a piece of plastic or elastomer, a tubular structure, or other suitable filler. In some arrangements, stitches 66A and 66B may be stitched to a dissolvable material such as polyvinyl alcohol that is dissolved after button 30 is formed so that button 30 is formed entirely of stitches.

Figure 17:
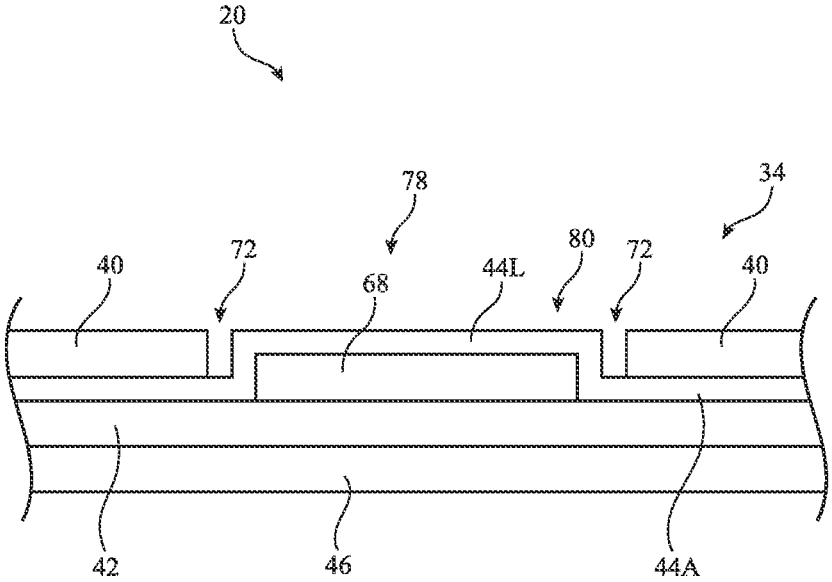
FIG. 17 is a cross-sectional side view of an illustrative case with a logo that is covered by a layer of fabric in accordance with an embodiment.

If desired, the button designs of FIGS. 4-16 may be applied to a logo in case 20 (e.g., by replacing button member 36 with a logo member in the shape of a logo). This type of arrangement is illustrated in FIG. 17. As shown in FIG. 17, case 20 may include a logo such as logo 78. Logo 78 may be formed on rear wall 34 of case 30, if desired. Logo 78 may have any suitable shape. Logo 78 may include a logo member such as logo member 68 located in opening 80 of case 20. Layer 44 may have an inner portion 44A that forms an inner layer of case 20 (e.g., interposed between outer fabric layer 40 and inner fabric layer 46) and logo portion 44L that forms an outer surface of logo 78. Layer 44 may extend between outer layer 40 and inner layer 46 of case 20, as shown in the example of FIG. 17. In other arrangements, layer 44 may be trimmed so that the edges of layer 44 terminate at locations 72 (e.g., at the base of logo 78). If desired, fabric 40 may be debossed (similar to the example of FIG. 7) around the perimeter of logo 78. Instead of wrapping over logo member 68 as in the example of FIG.

17, portion 44L of layer 44 may form a substrate for logo member 68 (e.g., similar to the arrangement of FIGS. 14, 15, and 16). Arrangements in which logo 78 is an embroidered logo (similar to embroidered button 30 of FIG. 16) may also be used. With this type of arrangement, logo member 68 may be formed from stitches that pass through portion 44L of layer 44. If desired, layer 44 and outer layer 40 may have one or more different characteristics (e.g., different colors, different fabric constructions, etc.) to provide logo 78 with a contrasting appearance from the surrounding outer layer 40.

If desired, the button configurations of FIGS. 4-16 may be used to form an array of buttons such as an array of keyboard keys in a keyboard. For example, button 30 may be a button in a keyboard. The keyboard may have an array of buttons 30 located in one or more openings in a keyboard housing. Layer 44 may have a first portion that forms at least part of an inner surface of the keyboard housing and may have a second portion that pokes through the one or more openings to cover buttons 30 or to form a substrate for buttons 30.

The foregoing is merely illustrative and various modifications can be made by those skilled in the art without departing from the scope and spirit of the described embodiments. The foregoing embodiments may be implemented individually or in any combination.

What is claimed is:

1. A case for an electronic device, the case comprising:
an inner wall that defines a recess configured to receive the electronic device;
an outer wall having an opening;
a button member in the opening; and
a layer of material having a first portion that forms at least part of the inner wall and a second portion that extends into the opening in the outer wall and that covers the button member.

2. The case defined in claim 1 wherein the layer of material has cut edges located at the inner wall.

3. The case defined in claim 1 wherein the layer of material comprises fabric.

4. The case defined in claim 3 wherein outer wall comprises a material selected from the group consisting of: fabric and polymer.

5. The case defined in claim 1 wherein the inner wall comprises an additional layer of material and wherein the first portion of the layer of material is interposed between the additional layer of material and the outer wall.

6. The case defined in claim 1 further comprising a button trim ring located around a periphery of the button member.

7. The case defined in claim 1 wherein the outer wall has a debossed portion that surrounds a periphery of the button member.

8. The case defined in claim 1 wherein the layer of material has a third portion that forms at least part of the outer wall.

9. The case defined in claim 1 wherein the button member is one of first and second button members located in the opening and wherein the layer of material wraps over the first and second button members and has a debossed portion between the first and second button members to allow the first and second button members to move independently of one another.

10. The case defined in claim 1 wherein the layer of material has a locally thinned region located at a periphery of the button member.

11. The case defined in claim 1 wherein the layer of material has slits located at a periphery of the button member.

12. The case defined in claim 1 wherein the layer of material comprises fabric and wherein the fabric has a first fabric construction in the first portion and a second fabric construction in the second portion that is different from the first fabric construction.

13. A case for an electronic device, the case comprising:
an inner wall that defines a recess configured to receive the electronic device;
an outer wall having an opening;
a button member in the opening; and
a layer of material having a first portion that forms at least part of the inner wall and a second portion that extends into the opening in the outer wall and that forms a substrate for the button member.

14. The case defined in claim 13 wherein the button member comprises a rigid member formed from a material selected form the group consisting of: plastic and metal.

15. The case defined in claim 14 further comprising a layer of fabric that covers the rigid member.

16. The case defined in claim 15 further comprising stitches that pass through the layer of fabric and the second portion of the layer of material to secure the button member to the second portion of the layer of material.

17. The case defined in claim 13 wherein the button member comprises an embroidered button member formed from stitches on the second portion of the layer of material.

18. A case for an electronic device, the case comprising:
an inner fabric layer that defines a recess configured to receive the electronic device;
an outer fabric layer having an opening;
filler material interposed between the inner and outer fabric layers;
a logo member in the opening; and
a layer of fabric that covers the logo member.

19. The case defined in claim 18 wherein the layer of fabric extends between the inner and outer fabric layers.

20. The case defined in claim 18 wherein the layer of fabric and the outer fabric layer have at least one different characteristic from one another selected from the group consisting of: color and fabric construction.

* * * * *